US011077446B2

(12) United States Patent
Knorr

(10) Patent No.: US 11,077,446 B2
(45) Date of Patent: Aug. 3, 2021

(54) STARTUP SEQUENCE FOR ROLLER CRUSHER

(71) Applicant: Metso Outotec USA Inc., Waukesha, WI (US)

(72) Inventor: Brian Knorr, Henrico, VA (US)

(73) Assignee: Metso Outotec USA Inc., Waukesha, WI (US)

( * ) Notice: Subject to any disclaimer, the term of this patent is extended or adjusted under 35 U.S.C. 154(b) by 111 days.

(21) Appl. No.: 16/148,500

(22) Filed: Oct. 1, 2018

(65) Prior Publication Data

US 2020/0101467 A1 Apr. 2, 2020

(51) Int. Cl.

| | |
|---|---|
| ***B02C 4/42*** | (2006.01) |
| ***B02C 4/32*** | (2006.01) |
| ***B02C 23/12*** | (2006.01) |
| ***B02C 4/28*** | (2006.01) |
| ***B02C 4/02*** | (2006.01) |

(52) U.S. Cl.

CPC ..... *B02C 4/32* (2013.01); *B02C 4/02* (2013.01); *B02C 4/286* (2013.01); *B02C 23/12* (2013.01)

(58) Field of Classification Search

CPC .. B02C 4/02; B02C 4/12; B02C 4/286; B02C 4/32; B02C 4/42

See application file for complete search history.

(56) References Cited

U.S. PATENT DOCUMENTS

| | | | | |
|---|---|---|---|---|
| 3,099,406 | A * | 7/1963 | Kautz | B02C 1/025 241/32 |
| 4,357,287 | A | 11/1982 | Schonert | |
| 5,088,651 | A * | 2/1992 | Takahashi | B02C 4/32 241/30 |
| 8,690,087 | B2 * | 4/2014 | Holl | B02C 4/38 241/30 |
| 10,807,098 | B1 * | 10/2020 | Sandnes | B02C 4/38 |
| 2014/0048634 | A1 * | 2/2014 | Brendler | B30B 3/04 241/27 |
| 2018/0272355 | A1 * | 9/2018 | Hoffmann | B02C 4/02 |
| 2019/0054476 | A1 * | 2/2019 | Green | A01G 3/002 |

FOREIGN PATENT DOCUMENTS

WO WO-2013156083 A1 * 10/2013 ..... B02C 4/286

* cited by examiner

*Primary Examiner* — Adam J Eiseman
*Assistant Examiner* — Dylan Schommer
(74) *Attorney, Agent, or Firm* — Andrus Intellectual Property Law, LLP

(57) ABSTRACT

System and method for controlling the startup sequence of a roller crusher is disclosed. The roller crusher includes two generally parallel rollers that are separated by a gap where the rollers rotate in an opposite direction. During startup, the gap between the rollers is greater than the gap during normal production and a feeding arrangement is run at a speed that is lower than a normal production feed rate. The rollers are rotated at a predetermined speed that is less than the speed during normal production. Other parameters of the system are set such that material is fed over the entire length of the rollers and the no crushing force is exerted during the startup. The method and system of the present disclosure reduces the amount of stress on the rolls, frame and hydraulic system of the roller crusher.

16 Claims, 3 Drawing Sheets

STARTUP SEQUENCE FOR ROLLER CRUSHER

FIELD

The present invention relates to a crushing device, especially a roller crusher where two, generally parallel rollers are separated by a gap and rotate in opposite directions and especially to a start-up sequence for such roller crusher.

BACKGROUND

When crushing or grinding rock, ore, cement clinker and other hard materials, roller crushers may be used having two generally parallel rolls which rotate in opposite directions, towards each other, and which are separated by a gap. The material to be crushed is then fed into the gap where comminution takes place. One type of roller crusher is called high pressure grinding rollers or high pressure roller crushers. This type of comminution has been described in U.S. Pat. No. 4,357,287 where it was established that it is in fact not necessary to strive for single particle breakage when trying to achieve fine and/or very fine comminution of material. Quite opposite, it was found that by inducing compression forces so high that briquetting, or agglomeration of particles occurred during comminution, substantial energy savings and throughput increases could be achieved. This crushing technique is called interparticle crushing. Here, the material to be crushed or pulverized is crushed, not only by the crushing surfaces of the rolls, but also by particles in the material to be crushed, hence the name interparticle crushing. U.S. Pat. No. 4,357,287 specifies that such agglomeration can be achieved by using much higher compression forces then what was previously done. As an example, forces up to 200 kg/cm2 where previously used, whereas the solution in U.S. Pat. No. 4,357,287 suggests to use forces of at least 500 kg/cm2 and up to 1500 kg/cm2. In a roller crusher having a roller diameter of 1 meter, 1500 kg/cm2 would translate into a force of more than 200 000 kg per meter length of the rollers whereas previously known solutions could, and should, only achieve a fraction of these forces. Another property of the interparticle crushing is that a roller crusher should be choke fed with the material to be crushed, meaning that the gap between the two opposed rolls of the roller crusher should always be filled with material along the entire length thereof and there should also always be material filled to a certain height above the gap to keep it full at all times and to maintain a state of particle-on-particle compression. This will increase the output and the reduction to finer material. This stands in sharp contradiction to older solutions where it was always emphasized that single particle breaking was the only way fine and very fine particle comminution could be obtained.

Interparticle crushing, as opposed to some other types of crushing equipment, such as e.g. sizers, has the attribute that it does not create a series of shocks and very varying pressure during use. Instead, equipment using interparticle crushing is working with a very high, more or less constant pressure on the material present in the crushing zone created in and around the gap between the rolls.

In this type of roller crusher, the gap width is created by the pressure of the feed material's characteristics. The movement of the crushing rolls away from each other is controlled with a hydraulic system comprising active hydraulic cylinders and accumulators, which accumulators provide a spring action to handle varied material feed characteristics. For example, a higher material feed-density to the roller crusher will normally cause a greater gap width than a lower material feeding-density would and uneven feed characteristics, such as non-uniform material feed distribution, along the length of the crusher rolls will cause the gap width to differ along the length of the crusher rolls, i.e. creating a skew. Skew can be defined as a difference in gap width when measured at the two opposite ends of the crusher rolls. Skew may also be defined in terms of gap width difference per length unit, e.g. mm/m or in terms of the angle between the central axis of the first roll and of the second roll. Herein, skew is defined as a difference in gap width when measured at the two opposite ends of the crusher rolls. Such uneven feed characteristics may be caused by uneven feed of the amount of material along the length of the crusher rolls, but may also be caused by different bulk density within the feed material, varying particle size distribution within the feed material, varying moisture content within the feed, and diversity of mineral breaking strength in material feed, but also by uncrushable material, which may enter into the feed material. One situation where particularly problematic load situations occur is during startup of the equipment. Startup is necessary in foreseen situations, such as after maintenance of the equipment, as well as unforeseen situations, such as after emergency shutdowns. During startup of previously known roller crushers, it is common that sudden load bursts, or load spikes, occur which are detrimental to the frame and the hydraulic system of the roller crusher. The wear surface of the rollers can also be damaged from these load bursts. Rollers usually have pins, studs or similar elements arranged over the outer surface thereof and these may become damaged from these startup load bursts. Also, the material of the outer surface of the rolls between the studs or pins, i.e. the surface of the rolls as such may also be damaged during these events.

SUMMARY

An object of the invention is to overcome, or at least lessen the above mentioned problems. A particular object is to provide a startup sequence for a roller crusher or a high pressure roller crusher. To better address this concern, in a first aspect of the invention there is provided a method for starting a roller crusher, where a gap width between the rolls is set to a predefined value x, where x is larger than the gap width during normal production X. Further, the feeding arrangement is run at a feed rate r which differs from normal production feed rate R, where $r<R$ and the rolls are rotated in opposite directions at a predetermined speed s, where $s>0$ rpm. The parameters of these steps are set such that: i) material to be crushed passes between the rolls along substantially an entire crushing length of the rollers and; ii) such that no or substantially no specific crushing force f is exerted to the material by the rolls, and when i) and ii) are achieved; r is increased gradually until desired production parameters of f and R are achieved. Previously known methods use rolls that rotate at production speed from the beginning and where the gap between the rolls is set to a minimum gap width, i.e. where the moveable bearing housings of the roller crusher abut a stop block or similar. Further, those methods use arrangements that feeds material to be crushed to the rolls with normal production feed rate right from the beginning and another important weakness is that when the machine starts the crushing work, partial feed conditions may occur. I.e. material will be reaching the rolls at limited parts thereof only. In such situation, the entire crushing force is applied to that small area only resulting in very high local pressures that may damage the roll surface, studs or pins. Also, such partial feed may cause skewing of the rolls. Those methods therefore put a lot of stress to the rolls, frame and the hydraulic system of the roller crusher with very high initial load spikes that in a worst case would cause failure of the rolls, frame and/or the hydraulic system. The startup method of the present invention has the advantage that loads occurring during startup increase gradually from a low level instead of abrupt load spikes. But at least as important is the fact that since material initially will pass the rolls along the entire length of the rolls without any, or at least no substantial crushing action taking place, the forces on the material to be crushed, and thus also the forces acting on the equipment, can build up evenly along the entire length of the rolls. This ensures that skewing due to uneven load distribution can be avoided or at least reduced to a large extent. Skewing of the equipment causes undesirable load situations in the roller crusher. The framework of these roller crushers are typically built to endure linear forces perpendicular to the longitudinal axis of the crusher rolls and skewing of the rolls will create forces that the framework is not suited to handle. Further, the moveable bearing housings of the moveable crusher roll often run on a guiding structure and in situations where skewing occur, there is a risk that the moveable bearing housing will cause jamming in the guiding structure and get stuck, thus being unable to respond to any required reciprocating movement. Needless to say, the skewing will cause unproportioned wear of the structure of the roller crusher. Thus, the present invention avoids load spikes and achieves even distribution of loads.

In accordance with an embodiment of the method, a force control set point F is set in step b) and r and/or F are increased in step e). The set point F defines the amount of pressure which the hydraulic system of the roller crusher can withstand, i.e. at pressures above this set point, the gap width x will start to increase. By gradually increasing F, the forces acting on the equipment can be built up over time.

In accordance with an embodiment of the method, in step c) the rolls are rotated at a reduced speed in comparison with a normal production speed S such that $s<S$. A reduced rotational speed of the rolls helps reduce the forces occurring during startup.

In accordance with an embodiment of the method, s is 20-40% of S.

In accordance with an embodiment of the method, s is 30-35% of S.

In accordance with an embodiment of the method, in step e), F and r are increased in a coordinated manner.

In accordance with an embodiment of the method, in step e), F and r are increased independent from each other.

In accordance with an embodiment of the method, r and/or F are increased only after f has reached a predefined value in response to an antecedent iteration. This means that the forces are increased gradually and the next iteration is only commenced once the effects from a previous iteration have been achieved.

In accordance with an embodiment of the method, r and/or F are increased only after r as defined in an antecedent iteration has lasted a predefined time. This has the advantage that the system can adapt to the change in feed rate r from a previous step before the next change occurs. Typical timespan for this may be 1-10 seconds, more typical 3-8 seconds and even more typical 5 seconds.

In accordance with an embodiment of the method, the speed of the rolls s is increased to S when f has achieved the operational state. When the crushing force f has reached its operational state, the rotational speed of the rolls is increased in order to match increasing feed rate r.

In accordance with an embodiment of the method, f is changed by changing distance x. In a situation with any given feed rate r and rotational speed s of the rolls, the crushing force f can be adjusted by changing the gap width x. Larger gap width will create a reduced crushing force f. This can be done in combination with or independent from the setting of the feed rate in order to change the crushing force f.

In accordance with an embodiment of the method, material passing the rolls is screened in a screening arrangement located downstream of the rolls and any oversize material is recirculated. By recirculating any oversize material that passes the rolls, material quality is enhanced and production rate in subsequent productions steps can be enhanced since downstream equipment will have to handle less oversize material.

In a second aspect of the invention there is provided a control system for a roller crusher, wherein said control system is configured to perform the steps in accordance with any of the foregoing embodiments. The advantages of this aspect correspond to those mentioned with respect to the method.

In a second aspect of the invention there is provided a roller crusher, wherein the roller crusher comprises a control system configured to perform the steps in accordance with any of the foregoing embodiments relating to the method. The advantages of this aspect correspond to those mentioned with respect to the method.

Other objectives, features and advantages of the present invention will appear from the following detailed disclosure, from the attached claims, as well as from the drawings. It is noted that the invention relates to all possible combinations of features. Especially, it is to be noted that all embodiments of any aspect of the invention can be applied correspondingly to all other aspects.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

As used herein, the term "comprising" and variations of that term are not intended to exclude other additives, components, integers or steps.

BRIEF DESCRIPTION OF THE DRAWINGS

The invention will be described in more detail and with reference to the appended drawings in which.

DETAILED DESCRIPTION

Figure 1:
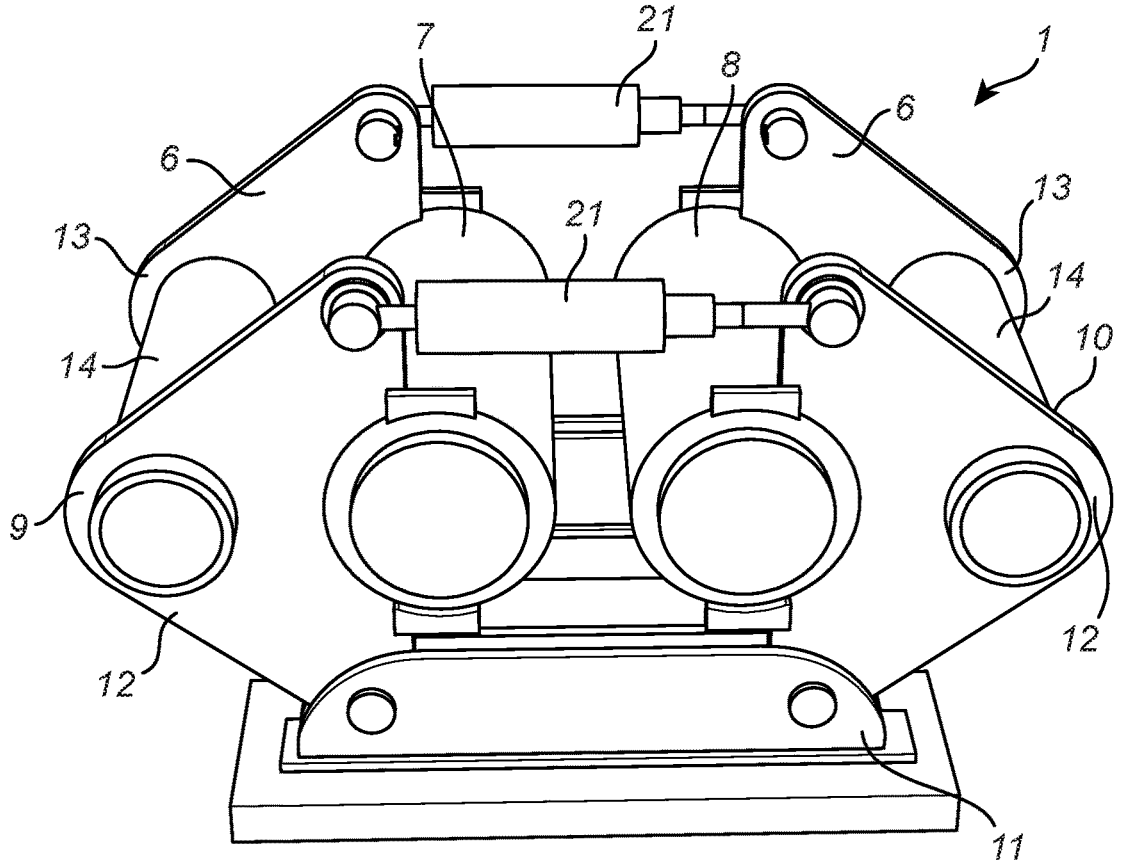
FIG. 1 shows a schematic perspective view of a roller crusher with which the present invention may be used.

The present invention will now be described more fully hereinafter with reference to the accompanying drawings, in which exemplifying embodiments of the invention are shown. The present invention may, however, be embodied in many different forms and should not be construed as limited to the embodiments set forth herein; rather, these embodiments are provided for thoroughness and completeness, and to fully convey the scope of the invention to the skilled addressee. Like reference characters refer to like elements throughout.

FIG. 1 shows a roller crusher 1 with which the invention is suitable to use. The roller crusher comprises a roller frame 6 in which the rolls 7, 8 are carried in bearings (not shown in the figure). The roller frame 6 comprises two roller frame sections 9, 10 each of which is pivotally mounted to base frame 11 and comprises a front and a rear roller plate 12, 13 and a spacer pipe 14 extending generally parallel to the rollers 7, 8 and connecting the roller plates 12, 13. Using a pipe and two roller plates provides a good weight-to-strength ratio. Main cylinders 21 for gap width adjustments are attached to upper regions of the front roller plates 12 and correspondingly to the rear roller plates 13. Main cylinders 21 are also used for reacting to forces occurring at the crusher rolls due to material fed to the roller crusher 1.

Figure 2:
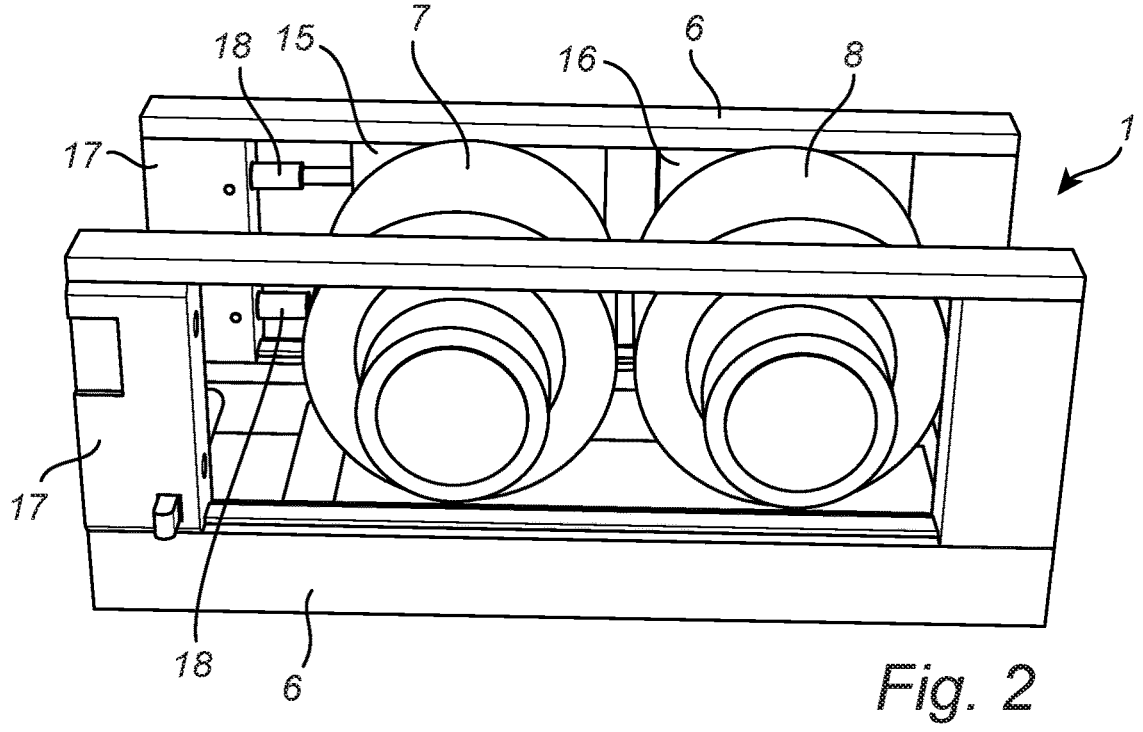
FIG. 2 shows a schematic perspective view of another roller crusher with which the present invention may be used.

FIG. 2 shows another type of roller crusher 1 with which the invention is suitable to use. Similar to FIG. 1, the roller crusher in FIG. 2 comprises a roller frame 6 in which the rolls 7, 8 are carried in bearings (not shown in the figure). The roller frame 6 comprises two moveable bearing housings 15 holding a moveable roll 7. For reasons of intelligibility only the rear bearing housing 15 arranged at rearmost end of roll 7 can be seen in FIG. 2. It is obvious that a corresponding front bearing housing will be provided at the opposing front end of moveable roll 7. The roller frame 6 further comprises two fixed bearing housings 16 holding a fixed roll 8. For reasons of intelligibility only the rear bearing housing 16 arranged at the rearmost end of roll 8 can be seen in FIG. 2. It is obvious that a corresponding front bearing housing will be provided at the opposing front end of fixed roll 8. End supports 17 are arranged at or near an end of the roller frame 6 and hydraulic cylinders 18 are provided between the end supports 17 and the moveable bearing housings 15. The hydraulic cylinders 18 are used for adjusting the gap width between the rolls 7, 8 and for reacting to forces occurring at the crusher rolls due to material fed to the roller crusher 1.

When the roller crusher according to the present invention is used, material to be crushed is fed into the gap between the rolls 7, 8 by means of a feeding arrangement (not shown in the FIGS. 1 and 2) typically located above the roller crusher 1. In accordance with the present invention, a programmable logic controller (PLC) is configured to perform a startup sequence of the roller crusher. A more detailed description of the startup sequence will now be discussed.

First, any material feed leading to the roller crusher 1 is brought to a halt such that no material enters the gap between the rolls 7, 8. Secondly, the gap between the rolls is adjusted to a width x exceeding the normal operating gap width X. This gap can be set to 2-7% of the diameter of the rolls, sometimes 3-4% of the diameter of the rolls. This is equipment dependent and may vary considerable. When the gap width x has reached its goal ±20 mm, the system is configured to proceed to the next step. It should be noted that the ±20 mm is not necessarily true in all situations. These values need to be selected for each equipment. The gap width x at this stage is larger than the diameter of particles that will be fed to the roller crusher 1 such that any particles of the material to be crushed will flow down more or less freely between the rolls 7, 8. This stands in sharp contrast to prior art equipment where the gap width is instead adjusted to the very minimum that is possible with the used equipment. Thus, a predefined roll gap is set and the cylinders 18, 21 are extended or retracted until gap width x is achieved.

Then, in a next step rotation of the rolls 7, 8 is initiated and rotated at a speed s which is less than the speed S used during normal operation of the roller crusher 1, typically about 20-40% of normal production speed S. An example of roll speed s is 5-7 RPM, which corresponds to ~30% of normal production speed.

After that, material is fed to the rolls 7, 8 at a reduced flow rate r. As an example, the material feed rate r at this stage can be ~40% of normal production feed rate R and since the gap width x is larger than the particle size, the material will pass down between the rolls 7, 8 without any crushing action taking place.

Subsequently, the hydraulic system controlling the gap width x between the rolls 7, 8 is activated and the gap is narrowed and/or the feed rate r is increased such that an initial crushing force f is built up in the material passing between the rolls 7, 8. It should be noted, however, that the crushing force f at this stage is still less than it would be during normal production. From here on, the feed rate r of material to be crushed and the hydraulics controlling the gap width are activated in a step-by-step manner. In one embodiment, the feed rate r is increased and the gap width x is narrowed in an alternating manner, i.e. one by one. It is also possible, in accordance with a further embodiment, to increase feed rate r and narrow the gap width x simultaneously. The first embodiment having the advantage that the crushing force f is increased in more linear, smoother manner whereas the second having the effect that the crushing force f is increased in a more stepwise manner. The crushing force f acting on the material is dependent on the feed rate r as well as the gap width and roller speed s. Thus, by adjusting these parameters in increments, the crushing force f can be built up at a reduced pace and without, or at least with reduced, destructive load bursts. In the embodiments above the rolls 7, 8 are kept at a reduced rotational speed s and only when the feed rate r of the material and/or gap width x between the rolls 7, 8 and/or crushing force f have achieved their production settings will the rotational speed s of the rolls be increased towards normal production speed S. Of course, rotational speed s of the roll can be incorporated into the step-by-step. Either the speed is increased in an alternating manner with the feed rate and the gap width or independently from them.

By the initial opening up of the gap width between the rolls to a position exceeding the normal production gap width and exceeding the diameter of the particles to be crushed, it can be achieved that the material to be crushed fed to the roller crusher 1 falls down between the rolls without any crushing forces acting on the material or the crushing equipment. Since it thus can be achieved that the flow of material between the rolls 7, 8 occurs along the entire length of the rolls 7, 8, much like a ribbon passing the gap between the rolls 7, 8, local load bursts along the surface of the rolls 7, 8 can be avoided as the gap width is reduced incrementally.

As the gap width is narrowed, the specific crushing force will eventually rise from zero, or near zero, to numbers above, or even well above, a force control set point F, which is the force the hydraulic system can withstand. After a while, however, the system will balance this out. Therefore, the system may be set up to wait until the specific crushing force f has been larger than the force control set point F for at least 5 seconds and then back down to the same as, or slightly higher than, the force control set point F before further changes to feed rate r and/or gap width and/or a new force control set point F is set in a subsequent step. Similarly, it can be defined that only when the feed rate r as defined in an antecedent iteration has lasted a predefined time shall a new force control set point F be set.

Thus, in accordance with the present invention, it is achieved that during startup of roller crusher material will be fed to the gap (steps 1-5) before any crushing force is exerted to the material. This will have the effect that a ribbon of material passing between the rolls along the entire crushing length L. Only when this ribbon of flowing material has been established, the control system will build up the pressure on the material, e.g. by reducing the gap width or increasing feed rate r. Since the material is passing between the rolls along their entire length L, no, or at least reduced, skewing will occur. Also, the fact that the method according to the present invention slowly builds up the pressure, no load spikes as they are common in prior art solutions, will take place. The avoidance of these two problematic events (skewing and load spikes) considerably reduces the stress on the equipment, prolonging life-span and reducing maintenance requirements.

Figure 3A:
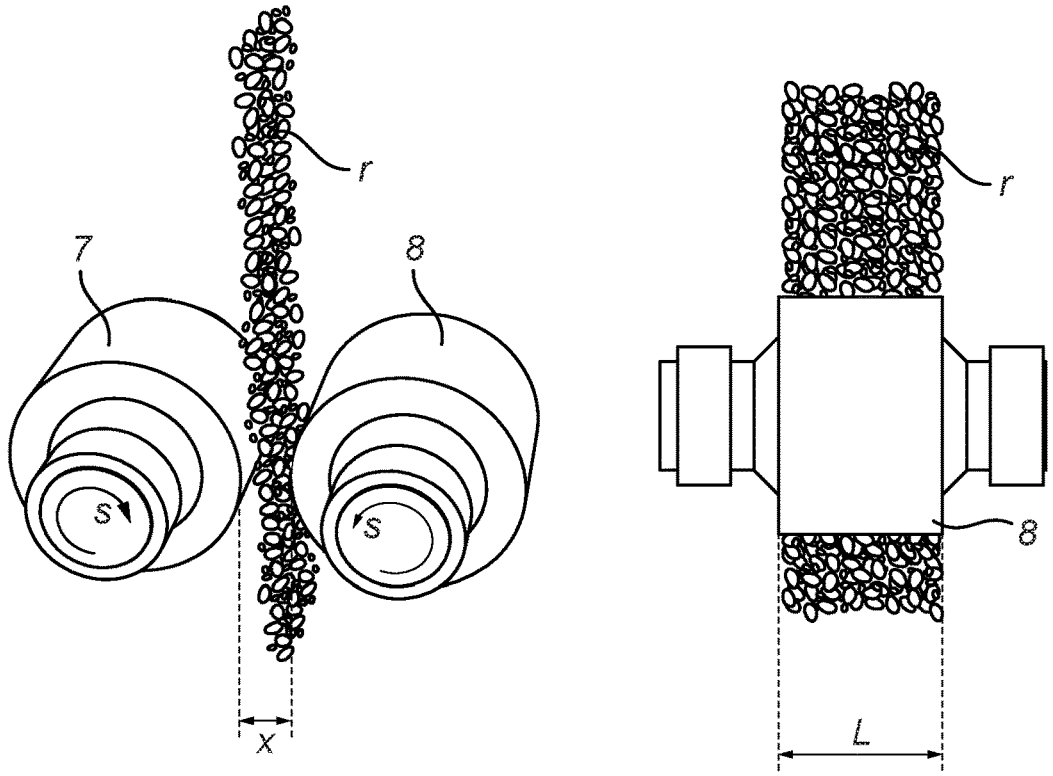
FIGS. 3*a* to 3*c* show schematic views of different steps of the startup sequence in accordance with the present invention.
Figure 3B:
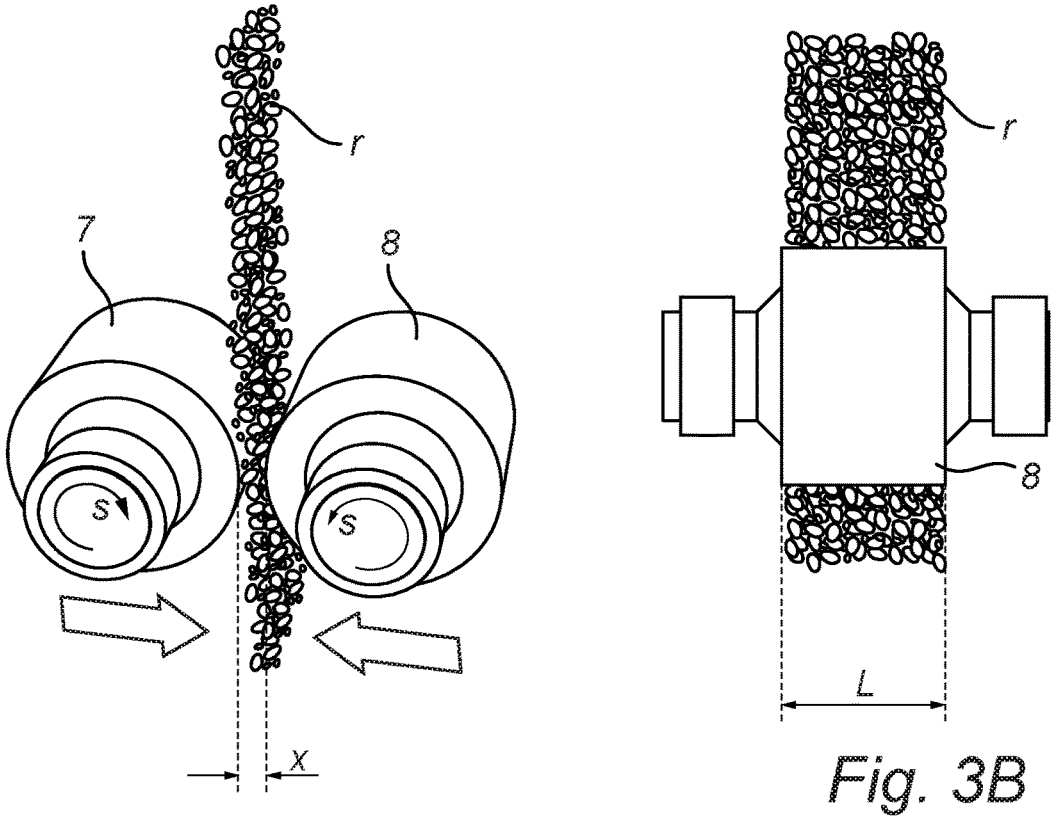
Figure 3C:
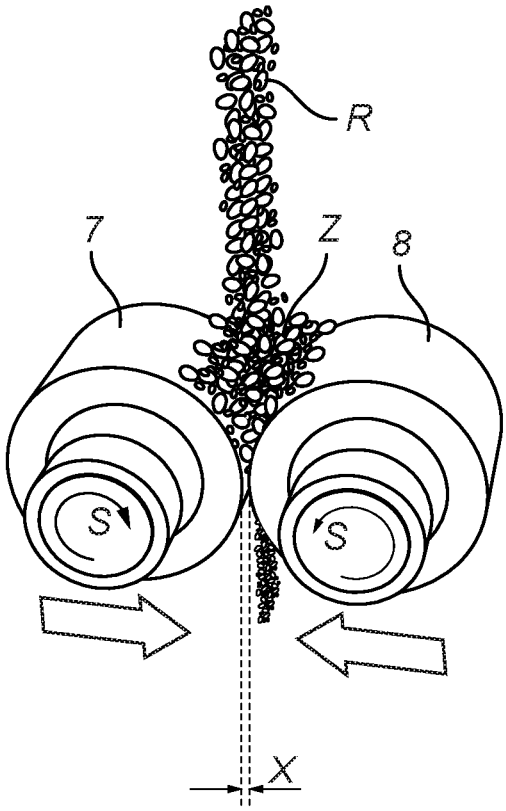
Figure 3C:
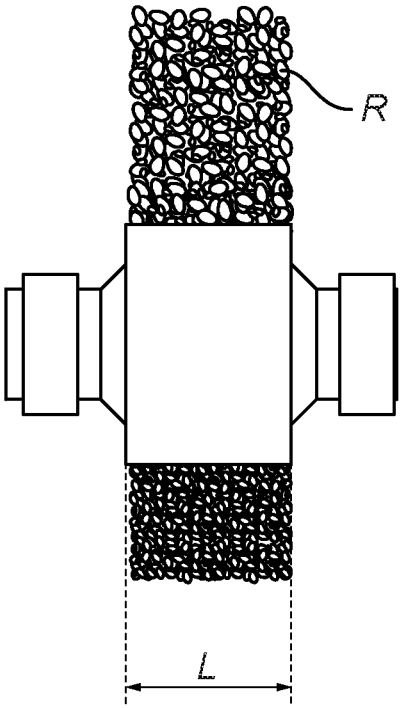

FIGS. 3*a* to 3*c* show the method of the present invention in a schematic manner. FIG. 3*a* discloses a first part of the startup sequence in accordance with the present invention. Here it can be seen how the gap width between the rolls 7, 8 has been set to a value x which is greater than the normal operational gap width X such that the feed of material flowing at a feed rate r will pass between the rolls 7, 8 without any, or at least with very little, crushing force acting on the material and therefore no forces will act on the rolls 7, 8 either. As can be seen, the feed of material is present along the entire crushing length L of the rolls 7, 8 at this stage. Immediately after initiation of material feed, the flow may occur over a partial length of the rolls 7, 8 but since the gap width is set to a width greater than the production operating gap, the large local load bursts occurring in prior art solutions can be avoided with the present invention. Then, as can also be seen in FIG. 3*b*, when the gap width is reduced towards the production operating gap X, the material feed occurs along the entire crushing length L of the rolls 7, 8 and the crushing force will gradually build up without the load bursts and spikes known from the prior art which may damage the equipment. In FIG. 3*c* a final situation can be seen. Here, a crushing zone Z occurring in choke fed equipment can be seen. This means that the gap between the two opposed rolls 7, 8 of the roller crusher 1 is filled with material along the entire length L thereof and there is also material filled up to a certain height above the gap to keep it full at all times and to maintain a state of particle-on-particle compression. This will increase the output and the reduction to finer material. In FIG. 3*c*, the production parameters r=R; s=S and; x=X have been reached and the equipment operates at production operating settings.

A screening arrangement may be arranged downstream of the rolls 7, 8, not shown in the figures. This screening arrangement may be part of a recirculating system which will handle any oversize particles passing the roller crusher 1, e.g. during startup and will feed the oversize material back to the roller crusher 1 for re-treatment prior to continuing to any further downstream comminution equipment.

The skilled person realizes that the present invention comprises a number of advantages and improvements within the scope of the appended claims. The fact that material to be crushed is allowed to pass through the gap between the rolls and along the entire crushing length thereof before any substantial crushing action takes place allows for forces acting on the equipment to build up gradually and without the detrimental load spikes known from previous solutions. The skilled person realizes that even though the application mentions the term "material to be crushed", this does not necessarily mean that the material fed to the rolls, 7, 8 is crushed, e.g. during startup when the material passes through between the rolls 7, 8 without any crushing taking place. Once this has been achieved, the skilled person realizes that the crushing forces can be increased by adjusting one or more parameters, such as but not limited to the feed rate; gap width, rotational speed of the rolls; and force control set point. These can each be adjusted independently or in a coordinated manner.

Two different types of roller crushers are depicted herein; the skilled person realizes that the invention is not limited to use with these only.

I claim:

1. A method for starting a roller crusher having two generally parallel rolls arranged to rotate in opposite directions and separated by an adjustable gap, wherein the roller crusher further comprises a feeding arrangement for feeding material to be crushed to the rolls, the method comprising the following steps:

a) setting a gap width between the rolls to a predefined value (x), where the predefined value (x) is greater than a production operating gap (X);

b) running the feeding arrangement at a feed rate (r) which differs from a normal production feed rate (R), where the feed rate (r) is less than the normal production feed rate (R);

c) rotating the rolls in opposite directions at a predetermined speed (s), where the predetermined speed (s) is greater than 0 rpm;

d) setting parameters in steps a)-c) such that i. material to be crushed passes between the rolls along substantially an entire crushing length (L) of the rolls; and ii. no or substantially no specific crushing force (f) is exerted on the material by the rolls, e) when i) and ii) are achieved, increasing the feed rate (r) gradually until desired production para meters of the production feed rate (R) and the crushing force (f) are achieved.

2. The method according to claim 1, further comprising the step of setting a force control set point (F) in step b) and increasing the feed rate (r) and/or the force control set point (F) in step e).

3. The method according to claim 1, wherein in step c) the rolls are rotated at a reduced speed in comparison with a normal production speed (S) such that the predetermined speed (s) is less than the normal production speed (S).

4. The method according to claim 3, wherein the predetermined speed (s) is 20-40% of the normal production speed (S).

5. The method according to claim 3, wherein the predetermined speed (s) is 30-35% of the normal production speed (S).

6. The method according to claim 2, increasing the force control set point (F) and the feed rate (r) in a coordinated manner in step e).

7. The method according to claim 2, increasing the force control set point (F) and the feed rate (r) independent from each other in step e).

8. The method according to claim 6, increasing the feed rate (r) and/or the force control set point (F) only after the crushing force (f) has reached a predefined value.

9. The method according to claim 7, increasing the feed rate (r) and/or the force control set point (F) only after the crushing force (f) has reached a predefined value.

10. The method according to claim 6, increasing the feed rate (r) and/or the force control set point (F) only after the feed rate (r) as defined in an antecedent iteration has lasted a predefined time.

11. The method according to claim 7, increasing the feed rate (r) and/or the force control set point (F) only after the feed rate (r) as defined in an antecedent iteration has lasted a predefined time.

12. The method according to claim 3, increasing the predetermined speed (s) of the rolls to the normal production speed (S) when production crushing force (f) and the crushing force (R) are achieved.

13. The method according to claim 1, changing the production crushing force (f) by changing the predefined value (x) of the gap width between the rolls.

14. The method according to claim 1, further comprising the following steps:

f) screening of material passing the rolls in a screening arrangement located downstream of the rolls; and g) recirculate any oversize material.

15. The method according to claim 8, increasing the feed rate (r) and/or the force control set point (F) only after the feed rate (r) as defined in an antecedent iteration has lasted a predefined time.

16. The method according to claim 9, increasing the feed rate (r) and/or the force control set point (F) only after the feed rate (r) as defined in an antecedent iteration has lasted a predefined time.

* * * * *